US006224118B1

(12) United States Patent
Ashford

(10) Patent No.: US 6,224,118 B1
(45) Date of Patent: May 1, 2001

(54) CHILD RESISTANT LATCH SYSTEM

(76) Inventor: Gordon J. Ashford, 53 Northumbria Road, Maidenhead Berks, SL63DG (GB)

( * ) Notice: Subject to any disclaimer, the term of this patent is extended or adjusted under 35 U.S.C. 154(b) by 0 days.

(21) Appl. No.: 09/368,694

(22) Filed: Aug. 5, 1999

(51) Int. Cl.[7] ..... E05C 3/04
(52) U.S. Cl. ..... 292/202; 292/62
(58) Field of Search ..... 292/202–204, 292/207, 209, 210, 226, 228, 57, 58, 62, 63, 64, 67

(56) References Cited

U.S. PATENT DOCUMENTS 606,101 * 6/1898 Thompson ..... 292/228
1,742,764 * 1/1930 Giltsch ..... 292/103
1,863,536 * 6/1932 Roedding ..... 292/332
2,546,535 * 3/1951 Barry ..... 292/63
2,670,932 * 3/1954 Westorfors ..... 292/25
2,914,597 * 11/1959 Gutman ..... 292/281

* cited by examiner

*Primary Examiner*—Gary W. Estrensky

(57) ABSTRACT

A child resistant latch system for minimizing a child's access to cabinets containing potentially harmful items includes a spring loaded biasing assembly for biasing a handle that is operationally coupled to a latch that is positioned proximate a stop plate. Optionally, a latch receiving plate assembly may be attached to a frame of the cabinet.

11 Claims, 2 Drawing Sheets

2
10
4

68
40
2
20
52
38
50
37
36
64
60
30
69
62
66
10

4
74
70
72
76

20
22

40
42

44
20
30
2

CHILD RESISTANT LATCH SYSTEM

BACKGROUND OF THE INVENTION

1. Field of the Invention

The present invention relates to locks and latches and more particularly pertains to a new child resistant latch system for minimizing a child's access to cabinets containing potentially harmful items.

2. Description of the Prior Art

The use of locks and latches is known in the prior art. More specifically, locks and latches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,647,618; U.S. Pat. No. 4,715,628; U.S. Pat. No. 3,999,792; U.S. Pat. No. 2,233,699; U.S. Pat. No. 3,397,001; and U.S. Pat. No. Des. 338,150.

While these devices fulfill their respective, particular objectives and requirements, the aforementioned patents do not disclose a new child resistant latch system. The inventive device includes a spring loaded biasing assembly for biasing a handle that is operationally coupled to a latch positioned proximate a stop plate.

In these respects, the child resistant latch system according to the present invention substantially departs from the conventional concepts and designs of the prior art, and in so doing provides an apparatus primarily developed for the purpose of minimizing a child's access to cabinets containing potentially harmful items.

SUMMARY OF THE INVENTION

In view of the foregoing disadvantages inherent in the known types of locks and latches now present in the prior art, the present invention provides a new child resistant latch system construction wherein the same can be utilized for minimizing a child's access to cabinets containing potentially harmful items.

The general purpose of the present invention, which will be described subsequently in greater detail, is to provide a new child resistant latch system apparatus and method which has many of the advantages of the locks and latches mentioned heretofore and many novel features that result in a new child resistant latch system which is not anticipated, rendered obvious, suggested, or even implied by any of the prior art locks and latches, either alone or in any combination thereof.

To attain this, the present invention generally comprises a spring loaded biasing assembly for biasing a handle that is operationally coupled to a latch positioned proximate a stop plate.

There has thus been outlined, rather broadly, the more important features of the invention in order that the detailed description thereof that follows may be better understood, and in order that the present contribution to the art may be better appreciated. There arc additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new child resistant latch system apparatus and method which has many of the advantages of the locks and latches mentioned heretofore and many novel features that result in a new child resistant latch system which is not anticipated, rendered obvious, suggested, or even implied by any of the prior art locks and latches, either alone or in any combination thereof.

It is another object of the present invention to provide a new child resistant latch system that may be easily and efficiently manufactured and marketed.

It is a further object of the present invention to provide a new child resistant latch system that is of a durable and reliable construction.

An even further object of the present invention is to provide a new child resistant latch system which is susceptible of a low cost of manufacture with regard to both materials and labor, and which accordingly is then susceptible of low prices of sale to the consuming public, thereby making such child resistant latch system economically available to the buying public.

Still yet another object of the present invention is to provide a new child resistant latch system which provides in the apparatuses and methods of the prior art some of the advantages thereof, while simultaneously overcoming some of the disadvantages normally associated therewith.

Still another object of the present invention is to provide a new child resistant latch system for minimizing a child's access to cabinets containing potentially harmful items.

Yet another object of the present invention is to provide a new child resistant latch system which includes a spring loaded biasing assembly for biasing a handle that is operationally coupled to a latch positioned proximate a stop plate.

Still yet another object of the present invention is to provide a new child resistant latch system that is usable with standard cabinet handles available without modification to the handle.

Even still another object of the present invention is to provide a new child resistant latch system that has substantially the same appearance of a standard conventional cabinet handle.

Even still another object of the present invention is to provide a child resistant latch system that requires special manipulation of a cabinet handle to release the latch from a stop plate in order to lock and unlock a cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
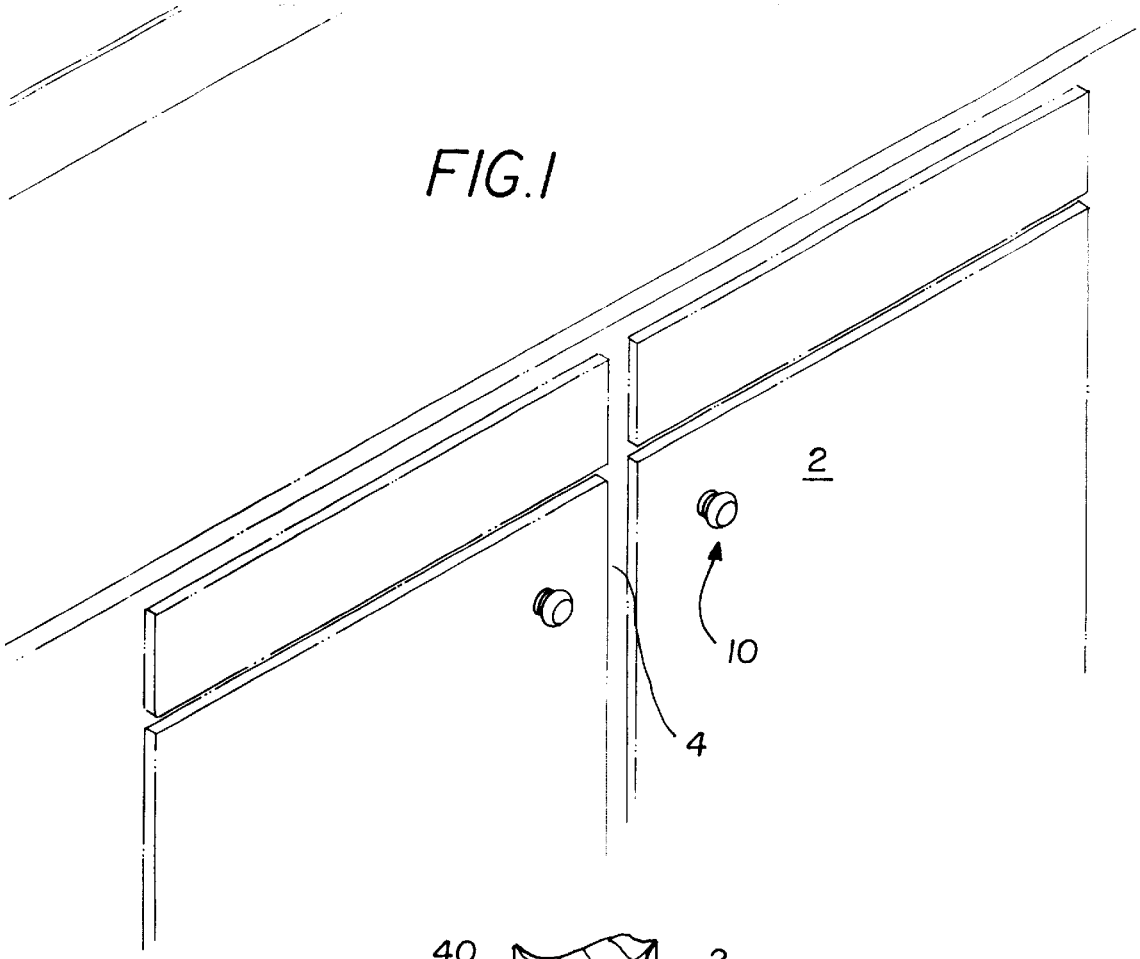
FIG. 1 is a schematic perspective view of a new child resistant latch system according to the present invention.
Figure 2:
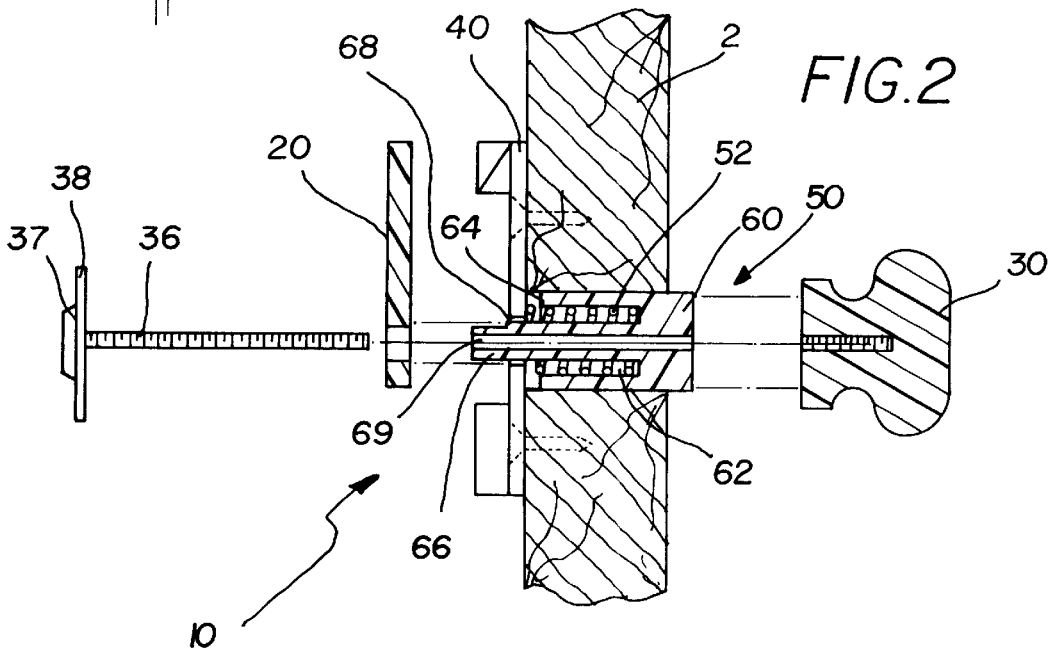
FIG. 2 is a schematic cross-sectional view taken along line 2—2 of FIG. 5.
Figure 3:
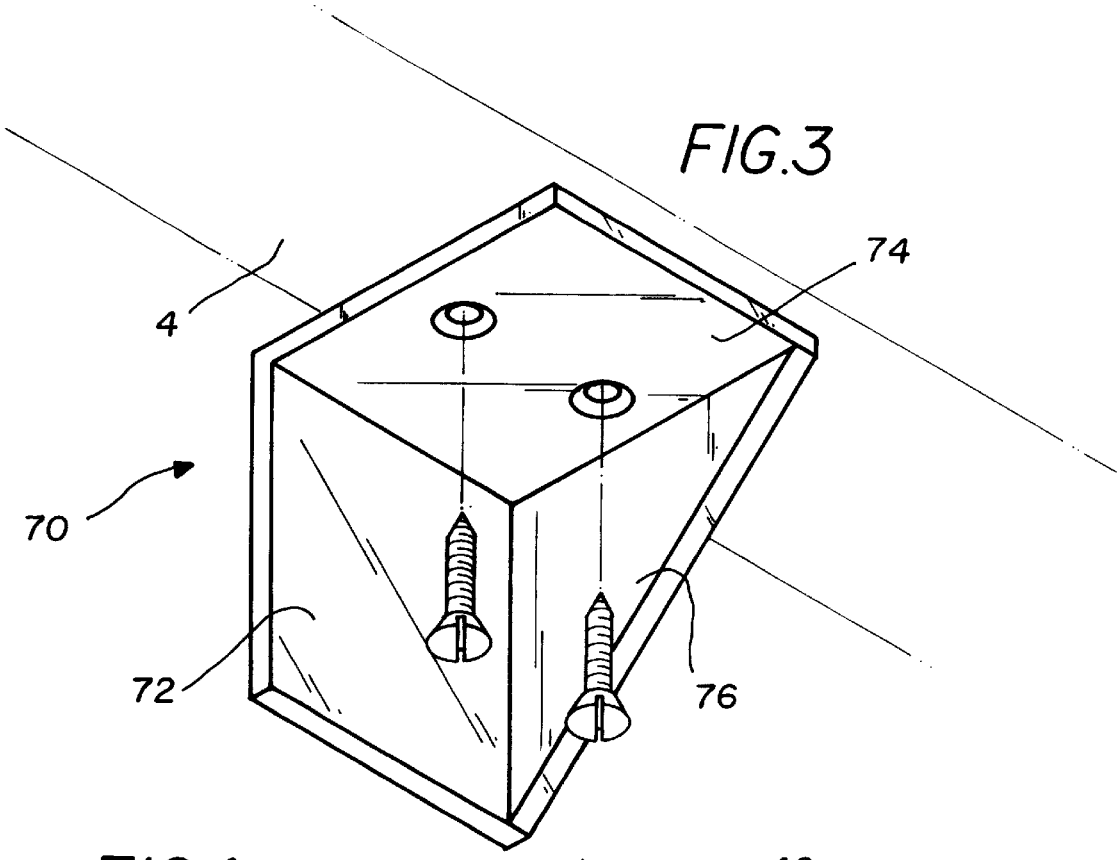
FIG. 3 is a schematic perspective view of the latch receiving plate assembly of the present invention.
Figure 4:
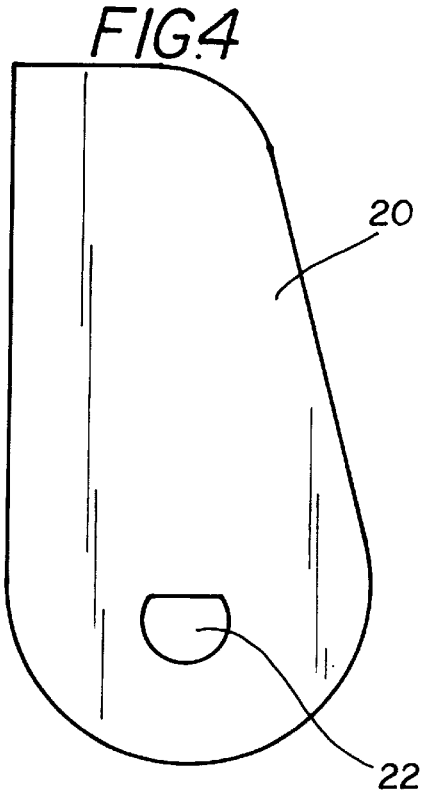
FIG. 4 is a schematic front view of the latch of the present invention.
Figure 5:
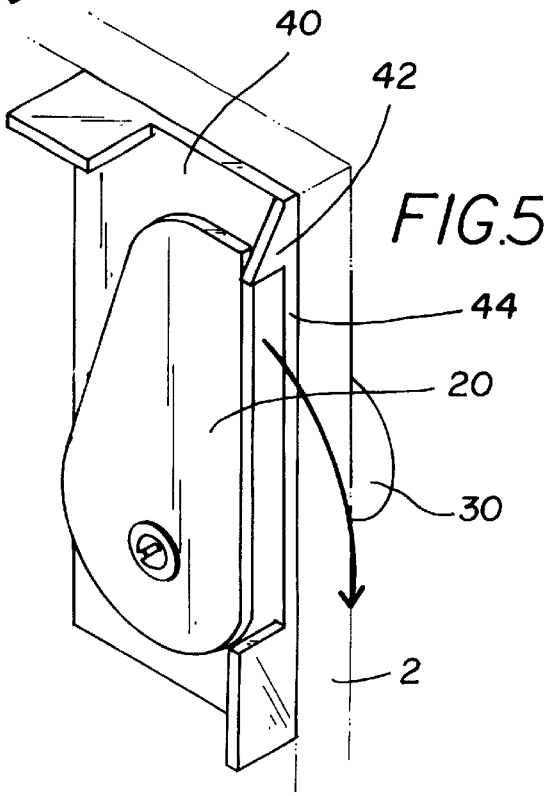
FIG. 5 is a schematic perspective view of the present invention.

With reference now to the drawings, and in particular to FIGS. 1 through 5 thereof, a new child resistant latch system embodying the principles and concepts of the present invention and generally designated by the reference numeral 10 will be described.

As best illustrated in FIGS. 1 through 5, the child resistant latch system 10 for minimizing a child's ability to open a door 2 generally comprises a latch member 20, a handle 30 operationally coupled to the latch member, a stop plate 40 having a latch stop 42, and a biasing assembly 50 for biasing the latch such that the latch stop engages the latch member to selectively prevent rotation of the latch member.

The stop plate 40 is designed for coupling to the door and includes a latch stop 42 that extends outwardly from an edge of the stop plate at substantially a right angle. The latch stop is positioned to engage a distal end of the latch member whereby the latch member is prevented from rotating.

The latch member is further designed to be manipulated into a locked position defined by the latch member extending outwardly from a perimeter edge 44 of the stop plate to engage a frame 4 of the door. Optionally, the latch may engage a latch receiving assembly 70 attached to the frame. Thus, the latch member is designed for preventing opening of the door when the door is closed and the latch member extends outwardly from the perimeter of the stop plate. The latch member can also be manipulated into an unlocked position defined by the latch member being positioned such that the door is free to move between an open and a closed position without the latch member engaging the frame of the door.

The biasing assembly includes a spring member 52 and a main member 60.

The main member is generally cylindrical and is designed for insertion into and through a circular hole in the door. The main member is further structured to have a spring chamber 62 for receiving an end of the spring member therein.

The main member also includes a connecting portion 66 extending outwardly from a first end 64 of the main member. The connecting portion is for inserting through the stop plate and a connection hole 22 in the latch. The connection hole is preferably non-circular such that rotation of the connecting portion results in a rotational force on the latch.

In use, the spring member is partially compressed between the stop plate and the main member. The stop plate is fixed to the door such that the spring member biases the handle outwardly from the stop plate and the latch to abut against the stop plate.

The connecting portion includes a lip 68 for abutting against the latch so that the latch is urged outwardly into a spaced relationship from the stop plate when the handle is urged towards the stop plate. The space provided between the stop plate and the latch is sufficient that the latch may now be rotated to clear the latch stop, thus permitting the latch to be rotated between the locked position and the unlocked position.

The main member includes a duct 69 extending fully through the main member and through the connecting portion. A bolt 36 is inserted fully through the duct in the main member and is attached to the handle. The bolt includes a bearing surface 37 for abutting the latch to hold the latch in position relative to the main member. Optionally, a washer 38 may be used between the bearing surface and the latch.

Optionally, a latch receiving plate assembly 70 may be installed on a door frame not structured to naturally engage the latch when the latch is in the locking, position. The receiving plate 70 includes a latch abutment plate 79, a frame connection plate 74 disposed from the latch abutment plate at substantially a right angle, and a support web 76 extending between edges of the abutment plate 72 and the connection plate 74. Optionally, the web plate also functions to prevent excessive rotation of the latch into the locked position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A child resistant latch system for minimizing a child's ability to open a door, the child resistant latch system comprising:

a latch member;

a handle operationally coupled to said latch member for selectively rotating said latch member;

a stop plate adapted for coupling to the door, said stop plate having a latch stop extending outwardly from the stop plate to engage said latch member whereby the latch member is prevented from rotating;

a biasing assembly for biasing said latch member into a position such that said latch stop prevents rotation of said latch member;

wherein said biasing assembly further comprises:

a spring member;

a main member adapted for insertion into a hole in the door, said main member being structured to have a spring chamber for receiving an end of said spring member therein;

said main member having a connecting portion extending outwardly from a first end of said main member, said connecting portion being for inserting through said stop plate and a connection hole in said latch member, said latch member being coupled to a distal end of said connecting portion;

said spring member being partially compressed between said stop plate and said main member whereby said spring member biases said latch member to abut against said stop plate;

said handle being coupled to said main member opposite said connecting portion whereby said handle is urgable towards said stop plate such that said latch member is urged into a spaced relationship from said stop plate whereby said latch member is rotatable.

2. The child resistant latch system of claim 1, further comprising:

said latch member being adapted for selectively manipulating into a locked position defined by said latch member extending outwardly from a perimeter edge of the stop plate for coupling to a frame of the door, whereby said latch member is adapted for preventing opening of the door when the door is closed and the latch member extends outwardly from the perimeter of the stop plate.

3. The child resistant latch system of claim 2, further comprising:

said latch member further being adapted for selectively manipulating into an unlocked position defined by said latch member being positioned such that the door is free to move between an open and a closed position without said latch member being coupled to the frame of the door.

4. The child resistant latch system of claim 1, further comprising:

a latch receiving plate assembly adapted for coupling to a frame of the door, said latch receiving plate assembly being for selectively abutting the latch member whereby the door is holdable in position relative to the frame.

5. The child resistant latch system of claim 1, further comprising:

said connecting portion having a lip for abutting against said latch member whereby said latch member is urged outwardly from said stop plate when said handle is urged towards said stop plate.

6. The child resistant latch system of claim 5, further comprising:

said main member having a duct extending fully through said main member, said duct extending through said connecting portion;

a bolt being inserted through said duct in said main member, said bolt being coupled to said handle whereby said latch member and said stop plate are coupled to said main member.

7. The child resistant latch system of claim 5, further comprising:

said latch member being adapted for selectively manipulating into a locked position defined by said latch member extending outwardly from a perimeter edge of the stop plate for coupling to a frame of the door, whereby said latch member is adapted for preventing opening of the door when the door is closed and the latch member extends outwardly from the perimeter of the stop plate.

8. The child resistant latch system of claim 7, further comprising:

said latch member further being adapted for selectively manipulating into an unlocked position defined by said latch member being positioned such that the door is free to move between an open and a closed position without said latch member being coupled to the frame of the door.

9. The child resistant latch system of claim 5, further comprising:

a latch receiving plate assembly adapted for coupling to a frame of the door, said latch receiving plate assembly being for selectively abutting the latch member whereby the door is holdable in position relative to the frame.

10. A child resistant latch system for minimizing a child's ability to open a door, the child resistant latch system comprising:

a latch member;

a handle operationally coupled to said latch member for selectively rotating said latch member;

a stop plate adapted for coupling to the door, said stop plate having a latch stop extending outwardly from the stop plate to engage said latch member whereby the latch member is prevented from rotating;

a biasing assembly for biasing said latch member into a position such that said latch stop prevents rotation of said latch member;

said latch member being adapted for selectively manipulating into a locked position defined by said latch member extending outwardly from a perimeter edge of the stop plate for coupling to a frame of the door, whereby said latch member is adapted for preventing opening of the door when the door is closed and the latch member extends outwardly from the perimeter of the stop plate;

said latch member further being adapted for selectively manipulating into an unlocked position defined by said latch member being positioned such that the door is free to move between an open and a closed position without said latch member being coupled to the frame of the door;

wherein said biasing assembly further includes a spring member;

a main member adapted for insertion into a hole in the door, said main member being structured to have a spring chamber for receiving an end of said spring member therein;

said main member having a connecting portion extending outwardly from a first end of said main member, said connecting portion being for inserting through said stop plate and a connection hole in said latch member, said latch member being coupled to a distal end of said connecting portion;

said spring member being partially compressed between said stop plate and said main member whereby said spring member biases said latch member to abut against said stop plate;

said handle being coupled to said main member opposite said connecting portion whereby said handle is urgable towards said stop plate such that said latch member is urged into a spaced relationship from said stop plate whereby said latch member is rotatable;

said connecting portion having a lip for abutting against said latch member whereby said latch member is urged outwardly from said stop plate when said handle is urged towards said stop plate;

said main member having a duct extending fully through said main member, said duct extending through said connecting portion; and a bolt being inserted through said duct in said main member, said bolt being coupled to said handle whereby said latch member and said stop plate are coupled to said main member.

11. The child resistant latch system of claim 10, further comprising:

a latch receiving plate assembly having a latch abutment plate, a frame connection plate extending substantially at a right angle from said latch abutment plate, and a web plate extending between said latch abutment plate and said frame connection plate;

said frame connection plate being adapted for coupling to the frame such that the latch abutment plate is adapted to extend outwardly from the frame whereby said latch abutment plate is positioned to selectively engage said latch member when said latch member is in said locked position.

* * * * *